United States Patent [19]

Beato

[11] 4,334,612

[45] Jun. 15, 1982

[54] COMBINATION SUPPORT SURFACE AND CARRIER FOR ELONGATED EQUIPMENT

[76] Inventor: Fernando J. Beato, 2424 W. 239th St., Torrance, Colo. 90501

[21] Appl. No.: 129,224

[22] Filed: Mar. 11, 1980

[51] Int. Cl.[3] ..... A45C 11/26

[52] U.S. Cl. ..... 206/314; 150/52 R; 190/18 A; 206/373

[58] Field of Search ..... 206/314, 372, 373, 479; 150/52 R, 52 C; 190/18 A

[56] References Cited

U.S. PATENT DOCUMENTS

| | | | |
|---|---|---|---|
| 1,217,357 | 2/1917 | Sparrow | 206/373 |
| 1,656,339 | 1/1928 | Runyorn | 150/52 R |
| 2,375,338 | 5/1945 | Alexander | 190/18 A |
| 2,747,636 | 5/1956 | Cauture | 150/52 R |
| 2,826,523 | 3/1958 | Blaszkowski | 150/52 R |
| 3,575,327 | 4/1971 | Harrison | 150/52 R |
| 4,223,783 | 9/1980 | Marshall | 206/373 |
| 4,241,833 | 12/1980 | Luebcke | 206/373 |

FOREIGN PATENT DOCUMENTS

| | | | |
|---|---|---|---|
| 2751184 | 8/1978 | Fed. Rep. of Germany | 190/18 A |
| 571328 | 1/1976 | Switzerland | 206/373 |

*Primary Examiner*—Herbert F. Ross

*Attorney, Agent, or Firm*—Don B. Finkelstein

[57] ABSTRACT

A relatively pliable device upon which equipment may stand when in normal use and to which the equipment may be fastened for transport and storage. The device may comprise a carpet having a substantially skid-proof pile surface and a backing. A water impervious material may be bonded to the backing and a number of fastening straps may be anchored to the carpet. When equipment is fastened to the carpet by the anchor straps, the carpet may be rolled into a cylindrical configuration in which it may be held by a plurality of exterior straps. A moveable shoulder strap may be fastened to the exterior straps for ease in carrying and handling the device. A wheeled cap may be mounted on one end of the carpet so that a person transporting it need not bear the entire weight.

8 Claims, 8 Drawing Figures

COMBINATION SUPPORT SURFACE AND CARRIER FOR ELONGATED EQUIPMENT

BACKGROUND OF THE INVENTION

The present invention relates to a device which may be utilized to transport generally elongated equipment in a safe and convenient manner, as well as to support that equipment during its normal use so that it will not tend to move relative to the floor.

Although the present invention will be described with reference to equipment such as that which is normally used by a professional musician, and, more particularly, a drummer, it will be realized that it could be similarly used for any relatively delicate equipment which should be protected when it is being transported from one location to another.

In most cases, a drummer uses a wide variety of drums any cymbals in any given instrument set up. In addition, he usually has a stool upon which he sits during an engagement or practice. Each of the drums, the cymbals, and the stool have a stand or legs for support during use. In order to allow compact storage and transportation of the stand and legs, they are usually manufactured so that they fold into a relatively compact, substantially elongated package.

In the past, in order to transport the stand and legs from one location to another, the drummer would have to fold them and/or break them down into individual pieces which could then be packaged either inside of or against the outside of a suitcase, sometimes called a "trap case."

Unfortunately, this prior art system has been both inconvenient and uneconomical since it results in scratching and damage to the legs and stands as they are broken down, mounted in or on the trap case, etc. In fact, the breaking down and reassembly of the equipment hastens the day upon which it must be replaced due to stripped threads, etc.

As a result, a need has existed for some time for a convenient packaging and transportation system for such equipment. The system should allow equipment to be conveniently gathered, maintained in a fixed position so that it cannot rub against other equipment and scratch and dammage it, and obviate the need for the equipment to be broken down and reassembled before and after each transportation.

In this same musical field of interest, most musicians are aware of the fact that a drummer prefers to have his equipment set up on a relatively skid-proof or high friction surface when he is using it so that his normal playing will not cause the drums and cymbals to move due to striking, percussion vibration, etc. Obviously, if such equipment does move, it becomes more and more diffficult for the musician to play the drums as the piece progresses since they tend to move further and further apart. In the past, however, in order for the musician to insure that he had a relatively high friction surface at his gig-site, it was necessary for him to bring a carpet or large bolt of material upon which he could arrange his equipment so that it would not move. If he failed to provide this himself, he either needed to make other arrangements with the owner of the job site or take his chances on giving less than his best performance as a result of the undesirable equipment movement. Consequently, the musician not only needed a storage and transportation device, but he also needed a skid-proof playing surface upon which to arrange his equipment at a gig. Also, since the equipment is relatively heavy, the musician needs both a flooring surface which is substantial and will stand up under wear and a transportation device which will remain relatively rigid so that it will protect the equipment and prevent it from being damaged.

Whereas, in the prior art, the musician could use a trap case to transport the legs and stands in a relatively safe configuration, even though he had to break most of them down each time, he had to provide his own carpet or else take a chance on accomplishing a less than satisfactory performance. On the other hand, although there have been devices for transporting elongated articles, such as the fishing rod carrying case depicted in U.S. Pat. No. 3,575,327, such devices have been rather flimsy and have served more as a convenient transportation system for relatively lightweight equipment, rather than as a protection device. In no known instance, has the prior art resulted in a transportation device for elongated equipment which will both protect the equipment and support it during its normal use.

SUMMARY OF THE INVENTION

The present invention relates to a device which solves both of the above-described problems of the musician-drummer. In other words, the device allows the drummer's equipment to be protected, stored, and transported in a relatively safe configuration which does not require that it be broken down every time the equipment location is to be changed. In its preferred embodiment, the device is also sufficiently rigid in its transportation configuration that it provides natural support and protection to the equipment.

At the job site, the musician can open the device, spread it out on the floor, and use it as a carpet beneath his equipment, thus rigidly supporting the equipment while, at the same time, providing an high friction surface which will prevent the equipment from moving relatively to the drummer as he plays it.

In order to protect both the carpeting and the equipment placed upon it, it is currently envisioned that a thin, pliable sheet material which is moisture impervious may be adhesively bonded to the backing or under side of the carpeting. Thus, if the carpeting is set down on a damp surface, or if it is exposed to rain when it is rolled up and carried outside, the pile and the equipment on the pile will not be damaged.

The device may be of any convenient size and shape, although it is currently envisioned that it will be generally rectangular, having a width sufficient to allow the longest of legs and stands to be laid across the carpet but not extend to the edges thereof. It is preferably long enough so that all of the equipment may be laid on the carpet in parallel relationship without coming into contact with adjacent equipment when the carpet is rolled up.

It is presently envisioned that equipment such as legs, stands, etc., will be laid across the width of the carpet and then fastened to the carpet. For this purpose a plurality of straps may be fastened intermediate their ends to the carpet and provided with snaps, Velcro strips, etc., so that the ends of the straps may be gathered over the equipment to hold it in place. Suitable supports and anchor structure may be provided to hold the straps to the carpet in such a manner as to prevent tearing and ripping of the carpeting and, if desired, to create sufficient rigidity to allow the carpeting to be rolled up and stored in its cylindrical configuration without requiring that equipment be located in the carpeting during the time that the carpet is stored. This may be accomplished, for example, by forming the support structures and the anchors so that the support structures extend substantially across the width of the carpeting. On the other hand, if the carpeting is sufficiently rigid in itself to prevent buckling when it is rolled up, the supports may be relatively small and merely extend a few inches about the anchors to which the straps are fastened.

Exterior straps may be similarly fastened to the moisture proof side of the carpeting so that when it is rolled up, the ends of the exterior straps may be gathered to one another, again such as by means of snaps, Velcro strips, etc. If desired, a shoulder strap may be attached to the exterior straps to allow the musician to carry his equipment, much as a caddy might carry a golf bag. Alternatively, a cap may be provided to fit over the end of the carpet when it is rolled up. The cap may be provided with straps which may be releasably fastened to the exterior straps and may also be provided with wheels to act as a dolly. Thus, in this alternate embodiment, the carpet and the equipment in it may be transported by the musician in a manner similar to a golf cart.

Although the invention as set forth in this application particularly relates to a device which has high utility for drummers and musicians, upon perusal of the following Detailed Description, taken together with the accompanying drawings, those skilled in the art will quickly realize that the present invention may be utilized with any equipment which must be protected and cared for during transportation with a minimum of breaking the equipment down into various parts. In many of those instances, the device may also be used to support the equipment when it is in normal usage.

DETAILED DESCRIPTION

Figure 1:
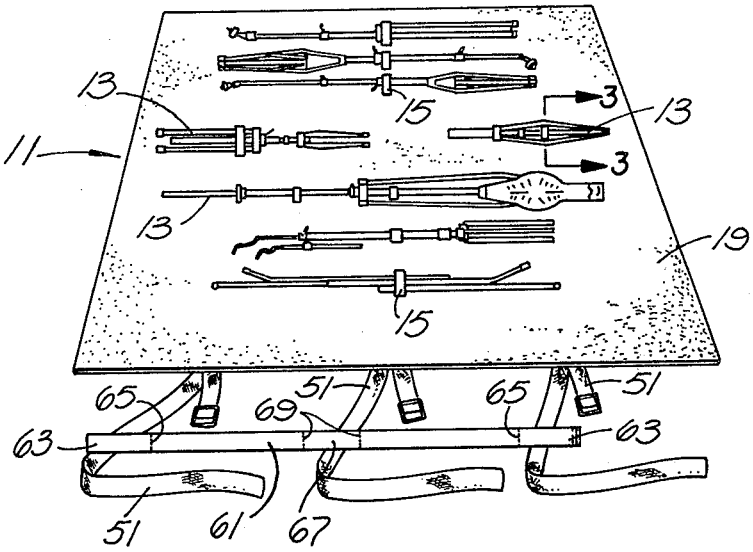
FIG. 1 comprises a perspective view of a preferred embodiment of the present invention depicting the manner in which a drummer's equipment may be positioned and fastened.
Figure 4:
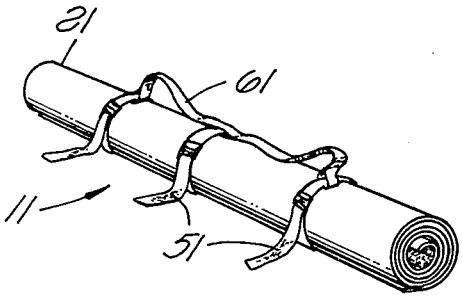
FIG. 4 comprises a perspective view of a device formed in accordance with the present invention in a cylindrical, rolled configuration.

Turning now to the drawings, there is shown in FIG. 1 a carpet-like device 11 upon which the legs and stands 13 for many different drummer's instruments have been laid in substantially parallel arrangement. Of course, any such structures could be laid on the carpet 11, but, if they are elongated in the manner illustrated, it is preferred that they be in parallel relationship so that the carpet may be rolled up with the objects inside, as illustrated in FIG. 4. In any event, each of the objects 13 may be firmly attached to the upper surface of the carpet by means such as straps 15 which will be described more fully below.

Figure 2:
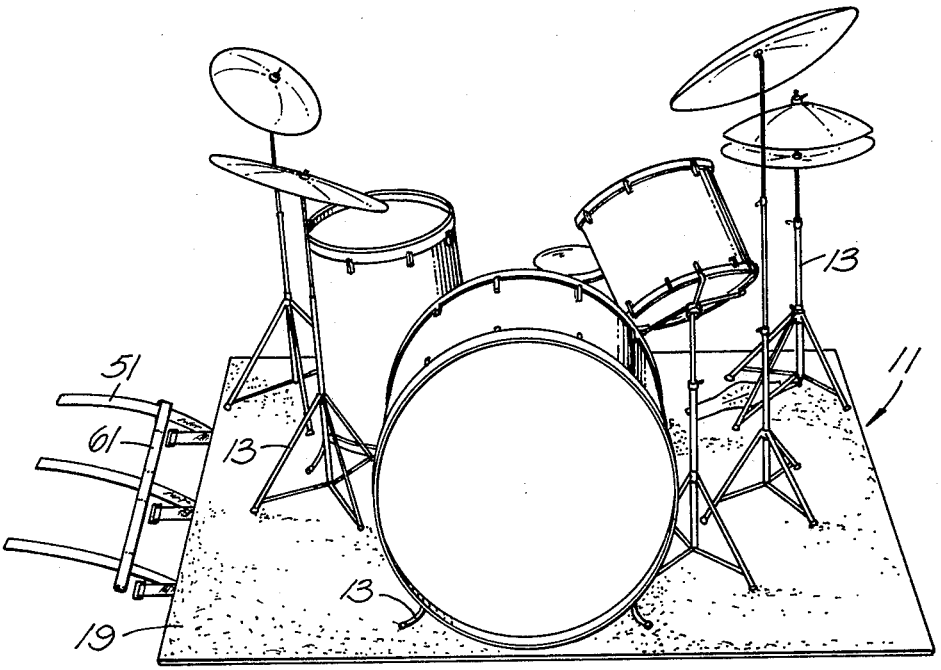
FIG. 2 comprises a perspective view of the device shown in FIG. 1 illustrating the manner in which the drummer's equipment might be placed during normal use.

As seen in FIG. 2, it is generally preferred that the carpet 11 be of sufficient size to allow it to be used as a base or floor support for the objects shown folded and arranged in FIG. 1. Thus, for example, the carpet-like element 11 is preferably of sufficient size to allow a drummer to arrange his drum and cymbal supports, seat stand, etc., as shown in FIG. 2, during normal use.

Figure 3:
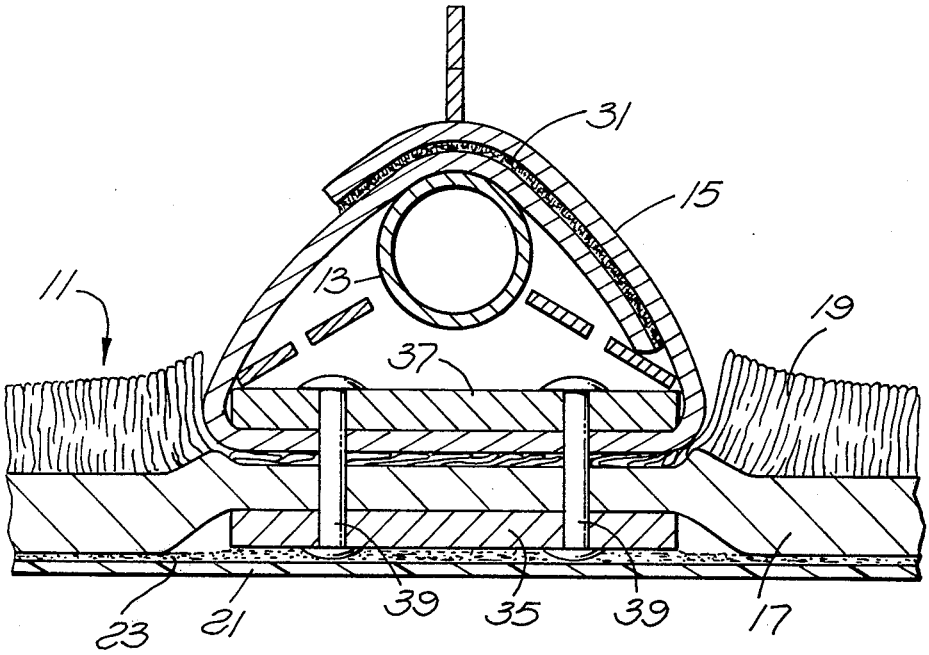
FIG. 3 comprises a partial sectional view of the device illustrated in FIG. 1, as seen along a line III—III.

Referring now to FIGS. 1 and 3 together, it can be seen that the carpet-like element 11 preferably comprises a backing 17 and a pile surface 19. In other words, the element 11 may comprise a fairly readily available carpet which is sufficiently pliable so that it can be rolled up in the usual manner. Preferably, a fluid or moisture impervious material 21 may be suitably attached to the undersurface of the backing 17 in any desired fashion, such as by a bonding agent or glue 23. If desired, the moisture proof material 21 can be suitably bound to the outer edges of the carpet so as to similarly protect those outer edges from moisture damage. In any event, it is preferred that the material 21 be substantially coextensive with the area of the carpet backing 17 so as to provide complete protection for the carpet. Similarly, in order to prevent separation and bunching of the carpet relative to the protective material 21, it is preferred that the bonding agent 23 be applied across all, or at least substantially all of the coextensive surfaces of the backing and the protective material.

As stated previously, any desired number of straps 15 may be suitably attached to the carpet material 11 in order to releasably fix the devices to be stored and transported, and thus prevent them from rubbing against one another and being scratched or otherwise damaged. As shown in FIG. 3, the opposite ends of a strap 15 may be suitably provided with cooperative Velcro fastening strips 31. Thus, when the inner surface of one end of the strap 15 is placed against the outer surface of the opposite end of the strap, the Velcro strips will become firmly attached to one another.

In order to firmly fix the belts or strap 15 to the carpet element 11, it has been found to be preferable to provide relatively rigid support means 35 between the backing 17 and the impervious material 21 and a similar relatively rigid support 37 on the pile side of the carpet element 11. The strap 15 may be installed between the pile 19 and the support 37 and one or more anchors 39 may be positioned as shown to hold the strap 15 against the carpet element 11 while minimizing any possibility of tearing the carpet through the imposition of excessive force on the strap or the anchors 39.

Of course, it will be realized by those skilled in the art that the supports 35 and 37 may extend across substantially the entire width of the carpet element or may simply be relatively small pieces which extend a little more than the width of the strap 15. Alternatively, the upper support 37 may be substantially the same width as the strap 15 and the lower support 35 may extend at least half of the width of the carpeting, or more. In other words, the specific dimensions of the upper and lower supports 35 and 37 may be chosen in accordance with the characteristics of the structure to be transported and the carpet element.

In any event, when the musician or other workman wishes to store and/or transport his equipment, it is only necessary that he disassemble the drums, cymbals, seats, etc., from the stands and move them out of the way. He can then simply fold up the legs and stand without disassembling them and suitably arrange them on the carpet as illustrated in FIG. 1. He can then fix the legs and stands to the carpet by joining the opposite ends of the belts or strap 15 as shown in FIG. 3, thus preventing relative movement of the workpieces.

Of course, those skilled in the art will realize that a wide variety of design choices might be made in producing a device utilizing the present invention. For example, the ends of the straps 15 may simply be joined by snaps or any other similar convenient device. Similarly, the pile 19 of the carpeting 11 might be very short or something other than carpeting may be used, so long as the upper surface upon which the transported workpieces are to be mounted can protect the workpieces. Whatever material is used (referred to herein generically as "carpet") it should substantially be skid-proof or, at least, present an high friction surface. As long as this is accomplished, if a drummer is using the device in the manner illustrated in FIG. 2, as he plays his instruments, they will have little or no tendency to "walk" across the floor, thus allowing him to keep and maintain them at convenient locations so that he can give a performance in accordance with his ability rather than one which might be marred by movement and tipping over of the instruments.

As shown most particularly in FIGS. 1 and 2, one or more belts 15 may be provided at one end of the carpet and may, preferably, be fixed thereto by any convenient means, such as stitching or snaps. In any event, when the carpet element 11 is rolled into the cylindrical configuration, rolling should begin at the end away from the straps or belts 51, i.e., toward the viewer as seen in FIG. 1. When it is completely rolled up, the straps 51 may then be used to hold it in the cylindrical configuration as shown in FIG. 4. The straps or belts may be provided with buckles, snaps, Velcro strips, etc., so that the carpet element 11 will be firmly held in the cylindrical configuration.

In order to provide easy transportation of the rolled device, a carrying strap 61 may be provided which cooperates with the belts 51. For example, a loop 63 may be formed at either end of the strap 61 by turning the strap back upon itself and suitably attaching the end of the strap by rivets, stitching, or any other suitable means as at 65. Similarly, a loop 67 may be formed near the center of the carrying strap 61. This may be accomplished, for example, by using an extra portion of strap material between rivets or stitching 69. Straps 51 may be threaded through the loops 63 and 67 as shown.

Figure 5:
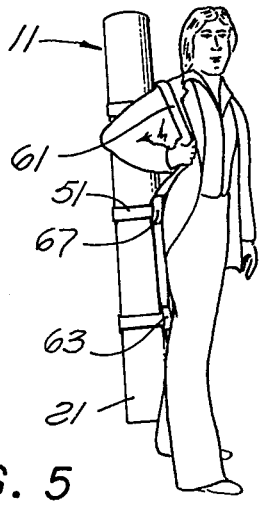
FIG. 5 is an illustration of the manner in which the device shown in FIG. 4 can be easily carried.

Loops 63 and 67 ease the burden of a person carrying the apparatus; he may select either end of the apparatus to be the upper end as shown in FIG. 5. In other words, since the loops 63 and 67 allows a controlled amount of movement between the carrying strap 61 and the belts 51, the portion of the carrying strap 61 between the center loop 67 and either of the end loops 63 may be passed over the shoulder of the person transporting it. Since there may be some relative movement between strap 61 and belts 51 depending upon the size of the loop, the person transporting the apparatus can select which of the portions of the carrying strap 61 he chooses to pass over his shoulder. Since the workpieces within the apparatus are tightly bound in place by means of the strap 15, it can be seen that it is immaterial, from the standpoint of preventing damage to the workpieces, which end is "up" during transport.

Figure 6:
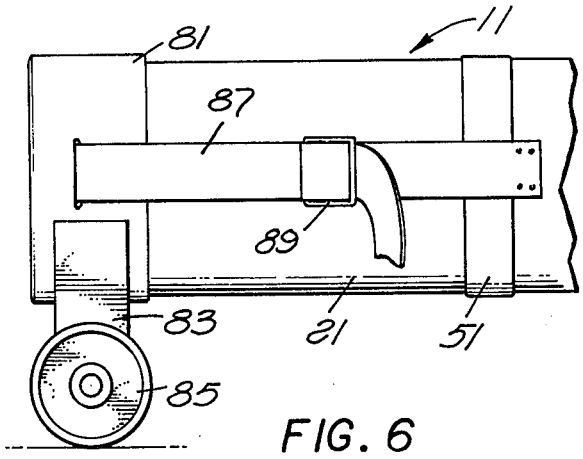
FIG. 6 comprises a partial side elevation of an alternate embodiment, illustrating the manner in which an end support cap can be attached to a device formed in accordance with the present invention.
Figure 7:
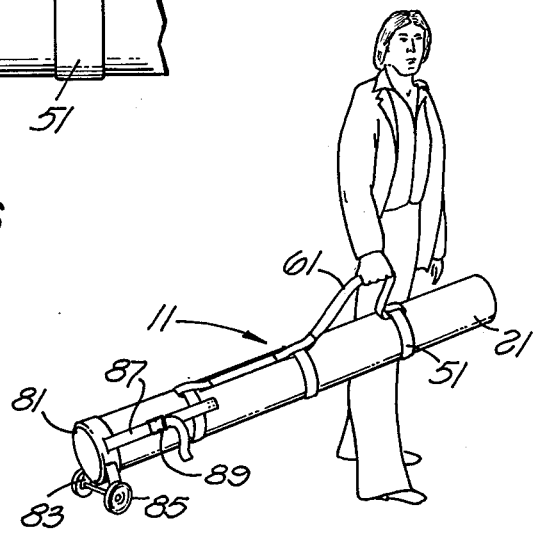
FIG. 7 comprises a depiction of the manner in which the alternate embodiment of FIG. 6 can be employed to facilitate the transport of a device formed in accordance with the present invention.

Referring now to FIGS. 6 and 7, an embodiment of the present invention is shown which may be employed to facilitate movement of the apparatus from one location to another. In this instance, an end cap 81 may be provided having a pair of flanges 83 upon which wheels 85 may be suitably mounted. One or more straps 87 may be suitably attached to the end cap 81 and passed over an adjacent belt 51 in the manner illustrated. The ends of the straps may be joined in any suitable fashion, e.g., a buckle 89 as illustrated. In any case, when the cap 81 is suitably installed on one end of the apparatus 11 as illustrated, the person wishing to move the apparatus need only grasp the shoulder strap 61 and pull it along, much as he might pull a golf cart.

Figure 8:
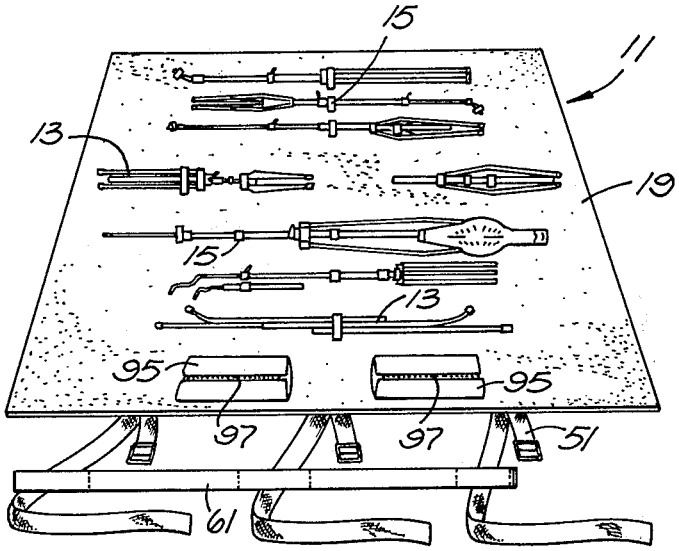
FIG. 8 comprises a perspective view of an alternate embodiment of the present invention depicting the manner in which storage compartments might be arranged.

Referring now to FIG. 8, it can be seen that the carpet element 11 may be provided with one or more suitable compartments or pockets 95 which may, for example, be provided with zippers or similar closure devices 97. In the depicted usage, for example, a drummer could store his felts, drum keys, sticks, etc., in such compartments, and they would be firmly held in place when the apparatus is rolled into the cylindrical configuration. At the same time, when the apparatus is rolled into the flat or planner configuration illustrated in FIG. 8, the closure elements 97 will prevent the pocket contents from falling out and becoming lost.

Having now reviewed the above description and the drawings, those skilled in the art will realize that a wide variety of embodiments may be employed in producing equipment in accordance with the present invention. In many instances, such embodiments may not even resemble that depicted here and may be used for applications other than that shown and described. Nevertheless, such embodiments will employ the spirit and scope of the invention as set forth in the following claims.

I claim:

1. Apparatus for protecting elongated objects, such as drum stands, during transport and for substantially immovably supporting such objects when the latter are in normal use, comprising:

a carpet means which is pliable so as to be selectively formed into a planar configuration and a substantially cylindrical configuration, the carpet means having a generally skid-proof exposed surface and a backing;

a substantially fluid impervious protective material, of a size approximately equal to the carpet means, located against the backing;

means for causing the protective material to closely adhere to the backing in both selective configurations;

means fastened to the exposed surface of the carpet for releasably fastening objects to be held thereon comprising at least one elongated strap means;

means for releasably fastening the ends of the at least one strap means together;

first support means located adjacent to the backing on one side of the carpet means and second support means on the side at the at least one strap means away from the exposed surface of the carpet means on the other side thereof; and anchor means extending through the first and second support means, strap means, and carpet means, but not through the fluid impervious protective material, to hold the support means, strap means, and carpet means in fixed relationship; and fastening means for releasably holding the carpet means in its cylindrical configuration.

2. Apparatus for protectively carrying elongated objects, such as drum stands, and for substantially immovably supporting such objects thereon in normal use comprising:

pliable means having a relatively soft face against which objects may be placed without being damaged or scratched, and a protective face bonded to the pliable means, on the side of the pliable means opposite the soft face, which is of material which is substantially impervious to moisture;

means for releasably binding objects against the soft face of the pliable means;

means comprising a pair of elongated relatively rigid elements located on each side of the pliable means, one of which is located between the pliable means and the protective face for supporting the binding means;

anchor means extending through the binding means and support means and at least part way through the pliable means but not through the protective face for fixing the binding means relative to the soft face; and means for retaining the pliable means in a substantially cylindrical configuration when the latter is rolled for transport.

3. The apparatus of claim 2 wherein the relatively soft face of the pliable means comprises a carpet including a backing and a pile upon which pile elongated objects may stand and the protective face comprises a material which is adhesively bonded to the backing.

4. The apparatus of claim 2 wherein said support means extends at least one-half the distance between opposed edges of the pliable means.

5. Apparatus for protecting elongated objects, such as drum stands, during transport and for substantially immovably supporting such objects when the latter are in use comprising;

a planar carpet which is pliable so as to allow the carpet to be laid flat on a floor or rolled into a substantially cylindrical configuration;

a water impervious material located on the underside of the carpet;

means permanently fixing the impervious material to the carpet;

at least two relatively rigid support means, located in opposed relationship on each side of the planar carpet and arranged so as to be substantially parallel to the first plane of the carpet and to the axis thereof when the carpet is in a cylindrical configuration;

binding straps fixedly attached to both of the support means on the side of the carpet opposite the water impervious material;

outer straps for holding the carpet in the cylindrical configuration; and end cap means releasably fastenable to and extendible over one end of the carpet when the latter is in the cylindrical configuration and having a pair of wheel means thereon for supporting the one end for movement.

6. The apparatus of claim 1, 3, or 5 including: flexible means movably attached to the exterior of the carpet when the latter is rolled into a cylindrical configuration for carrying the device with either end elevated.

7. The apparatus of claim 1, 2, or 5 including: compartment means affixed to the side of the apparatus opposite the impervious material for releasably storing relatively small objects.

8. Apparatus for protecting elongated objects, such as drum stands, during transport and for substantially immovably supporting such objects when the latter are being used comprising:

a carpet means which is pliable so as to be selectively formed into a planar configuration and a substantially cylindrical configuration, the carpet means having a generally skid-proof surface which is exposed for substantially immovable support of the objects in use and a backing;

means fixed relative to the skid-proof surface for fastening the objects against the skid-proof surface for during storage and transport;

a normally planar, fluid impervious, protective material located against and fixed to the backing substantially throughout the extent thereof, the protective material being sufficiently pliable to not inhibit rolling of the carpet means into the substantially cylindrical configuration with the protective material exposed on the outside of the cylinder and the planar configuration with the protective material against the floor or ground;

means for attaching the fixing means to the backing of the carpet means for firmly supporting the fixing means without breaking the surface of the protective material;

strap means fixed to the carpet means near one edge thereof for holding the carpet means in the cylindrical configuration; and means forming an end cap for placement thereof over an end of the carpet means when the latter is in the cylindrical configuration, including means providing an axis for support of a pair of ground-traversing wheels on the end cap, and means for fastening the end cap to the strap means.

* * * * *